US007477126B2

(12) United States Patent
Weber et al.

(10) Patent No.: US 7,477,126 B2
(45) Date of Patent: Jan. 13, 2009

(54) WINDING FOR A TRANSFORMER OR A COIL AND METHOD FOR THE PRODUCTION THEREOF

(75) Inventors: Benjamin Weber, Winterberg (DE); Christian Gruettner, Erwitte (DE)

(73) Assignee: ABB Technology AG, Zurich (CH)

( * ) Notice: Subject to any disclaimer, the term of this patent is extended or adjusted under 35 U.S.C. 154(b) by 36 days.

(21) Appl. No.: 10/594,423

(22) PCT Filed: Mar. 10, 2005

(86) PCT No.: PCT/EP2005/002520

§ 371 (c)(1),
(2), (4) Date: Dec. 6, 2006

(87) PCT Pub. No.: WO2005/098881

PCT Pub. Date: Oct. 20, 2005

(65) Prior Publication Data

US 2007/0132532 A1 Jun. 14, 2007

(30) Foreign Application Priority Data

Apr. 1, 2004 (DE) ..... 10 2004 016 197

(51) Int. Cl.
*H01F 27/30* (2006.01)

(52) U.S. Cl. ..... 336/205; 336/200

(58) Field of Classification Search ..... 336/205, 336/206, 207, 213, 199
See application file for complete search history.

(56) References Cited

U.S. PATENT DOCUMENTS 3,410,738 A 11/1968 Gorton, Jr.
3,528,852 A 9/1970 Olson et al.
3,891,955 A * 6/1975 Horton, III. ..... 336/205
4,860,446 A 8/1989 Lessar et al.
5,262,746 A 11/1993 Masuda
5,296,260 A 3/1994 Sawada et al.
5,528,820 A 6/1996 Collier
6,873,236 B2 * 3/2005 Shah et al. ..... 336/58
6,931,713 B2 * 8/2005 Roshen ..... 29/609
2005/0052271 A1 * 3/2005 Nakatsu et al. ..... 336/206

FOREIGN PATENT DOCUMENTS

DE 1 819 904 U 10/1960

(Continued)

OTHER PUBLICATIONS

*International Search Report dated Jun. 6, 2005.

(Continued)

*Primary Examiner*—Anh T Mai
(74) *Attorney, Agent, or Firm*—Buchanan Ingersoll & Rooney PC

(57) ABSTRACT

The invention relates to a winding for a transformer or a coil. Said winding is made of a winding material comprising a strip-type electric conductor which is connected in a detachable manner to at least one wide side having at least one layer of insulating material. The winding material is wound about a winding axis in order to prevent axial offset in order to form the threads. The invention further relates to a method for the production of said type of winding.

22 Claims, 2 Drawing Sheets

FOREIGN PATENT DOCUMENTS

Figure 1:
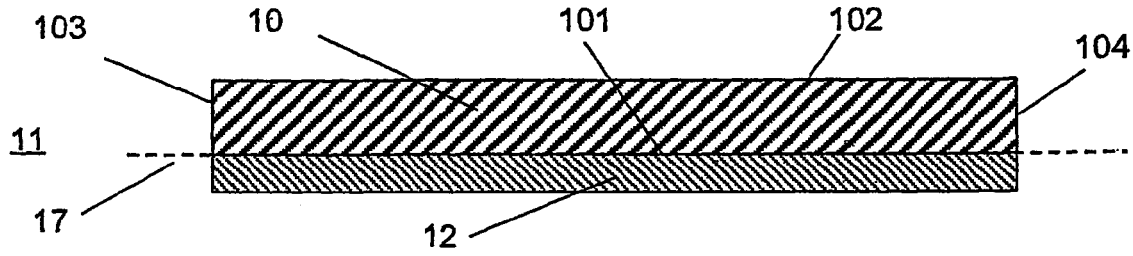

| | | | |
|---|---|---|---|
| DE | 67 50 037 | U | 1/1969 |
| DE | 1 816 127 | B | 3/1970 |
| DE | 29 49 739 | C2 | 6/1981 |
| DE | 40 07 614 | A1 | 9/1990 |
| DE | 689 18 129 | T2 | 1/1995 |
| DE | 690 33 019 | T2 | 10/1999 |
| EP | 0 249 252 | A1 | 12/1987 |
| GB | 981385 | A | 1/1965 |
| JP | 2000-058350 | A | 2/2000 |

OTHER PUBLICATIONS

German Search Report dated Oct. 21, 2004 (with English translation of category of cited documents).

* cited by examiner

WINDING FOR A TRANSFORMER OR A COIL AND METHOD FOR THE PRODUCTION THEREOF

The invention relates to a winding for a transformer or a coil, as claimed in the precharacterizing clause of claim 1. The invention also relates to a method for production of a winding according to the invention.

Windings for transformers or coils are generally produced from an electrical conductor in the form of a strip. A conductor such as this is wound around a winding axis to form turns during the production of the winding. In order to ensure that the individual turns are electrically isolated from one another, an insulating material is interposed between radially adjacent turns.

In order to produce a winding, the conductor and a separate insulating material in the form of a strip are fitted to a respective feed roll apparatus for a winding machine, thus requiring corresponding fitting times. In order to prevent short-circuits between individual turns, it is necessary to ensure while winding the turns that the conductor does not project beyond the insulating material at the side. In order to compensate for tolerances and linear movements during the winding process, the insulation material must therefore be significantly broader, for example by 20 mm, than the conductor.

Against the background of the abovementioned prior art, the object of the invention is to specify a winding which can be produced particularly easily for a transformer or a coil, and a corresponding production method.

According to the invention, this object is achieved by a winding for a transformer or a coil having the features mentioned in claim 1.

A winding according to the invention is accordingly characterized in that an electrical conductor which is in the form of a strip and is wound around the winding axis in order to form turns is non-detachably connected to at least one insulating material layer on at least one broad face.

The insulating material layer, which is already connected to the conductor during the production of the winding, ensures the electrical isolation between radially adjacent turns. This avoids faults caused by the conductor sliding with respect to the insulating material layer during the winding process. In addition, there is no need for technical measures which are otherwise required to avoid sliding. This therefore considerably simplifies the production of a winding.

Furthermore, radially adjacent turns are wound without any axial offset with respect to one another, that is to say all of the turns are located completely one on top of the other. This further simplifies the production of the winding, and the extent of the winding in the axial direction is reduced.

The connection of the conductor to the insulating material layer is advantageously produced over the complete area on the broad face. A connection over the complete area reduces the risk of tearing off or partial detachment of the insulating material layer from the conductor, as exists in particular during the winding process. However, it is also feasible for the conductor to be connected to the insulating material layer only in places, by means of adhesion spots or by adhesive bonding in the form of a strip or strips.

In one advantageous refinement, the conductor is non-detachably connected to a respective insulating material layer on both broad faces. Two radially adjacent turns of the conductor in the winding are then isolated by two respective insulating material layers located one on top of the other. If one insulating material layer is faulty, for example by having a hole or a crack, then a further insulating material layer is also provided, which ensures the isolation between the turns.

The turns are advantageously designed such that the conductor is arranged with its lateral direction, which is located in its broad face and is at right angles to its longitudinal direction, parallel to the winding axis. The winding is thus formed in a particularly compact and space-saving manner.

The width of the insulating material layer corresponds approximately to the width of the conductor. This means that the insulating material layer is advantageously only as broad as the conductor itself. This results in a saving of insulating material.

The object according to the invention is also achieved by a method for production of a winding for a transformer or a coil having the features stated in claim 13.

On the basis of the method according to the invention, a winding material in the form of a strip is wound around a winding axis without any axial offset to form turns. The winding material in this case has an electrical conductor, which is in the form of a strip and is non-detachably connected to at least one insulating material layer, at least on one broad face.

There is therefore no need, as in the past, to fit at least two separate materials, specifically a conductor and an insulating material, to at least two different feed apparatuses on a winding machine, but only one winding material onto one feed apparatus, thus shortening the required preparation time, or fitting time. Furthermore, the use of the winding material prevents the conductor strip from moving with respect to the insulating material strip during the winding process in such a manner that complete coverage of the broad face of the conductor strip is no longer ensured.

In one advantageous development of the method according to the invention, the winding material is produced before the winding of the turns by the conductor being non-detachably connected to the insulating material layer on one broad face. In this case, it is particularly advantageous for the conductor to be connected to the insulating material layer over its entire area. This minimizes the risk of the insulating material layer becoming detached from the conductor in places during the winding process.

In one advantageous refinement of the method according to the invention, the winding material is produced by connection of the conductor to a respective insulating material layer on both broad faces. During the winding of the turns, two respectively opposite insulating material layers are then formed between two radially adjacent turns of the conductor. A winding strip such as this ensures adequate isolation between radially adjacent turns even if one of the insulating material layers is faulty in places.

In one particularly advantageous refinement of the invention, the at least one insulating material layer of the winding material is additionally non-detachably connected to the respective radially adjacent turn. In this case, the broad face of the insulating material layer which faces away from the conductor is connected to the broad face of the winding material of the respective radially adjacent turn.

If the winding material has only one insulating material layer, then this insulating material layer on one turn is connected to the conductor of the adjacent turn. If the winding material has a respective insulating material layer on both broad faces of the conductor, then one insulating material layer on one turn is connected to an insulating material layer on the adjacent turn. Such additional connection of the turns to one another advantageously increases the mechanical strength of the winding.

The additional connection is produced, for example, in the form of adhesive bonding, by application of an additional adhesive layer to the insulating material layer before or during the winding process. Alternatively, the insulating material layer may already contain an adhesive.

Furthermore, the insulating material layer can be made available for the production of the winding material in a solid but uncured state. The adhesive bonding then takes place after the winding of the turns in a separate curing process which is carried out, for example, by heating of the winding.

Further thermal or chemical processes, which allow the insulating material layer to be connected to the conductor or allow two insulating material layers to be connected to one another, can also be used.

Further advantageous refinements of the invention can be found in the further dependent claims.

Figure 2:
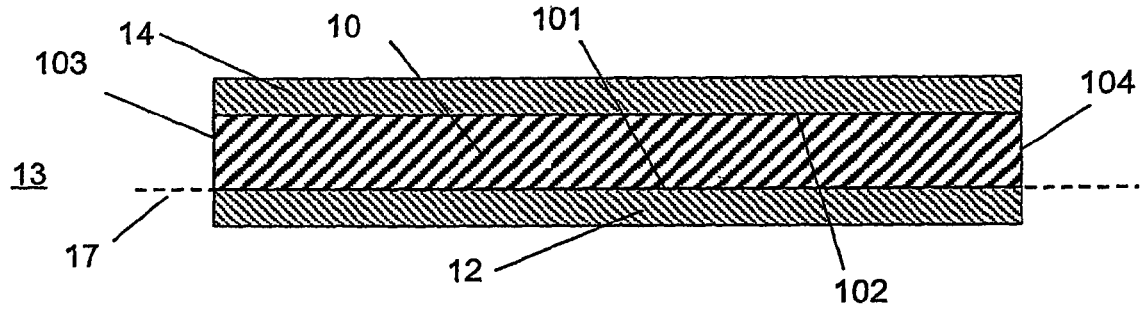
Figure 3:
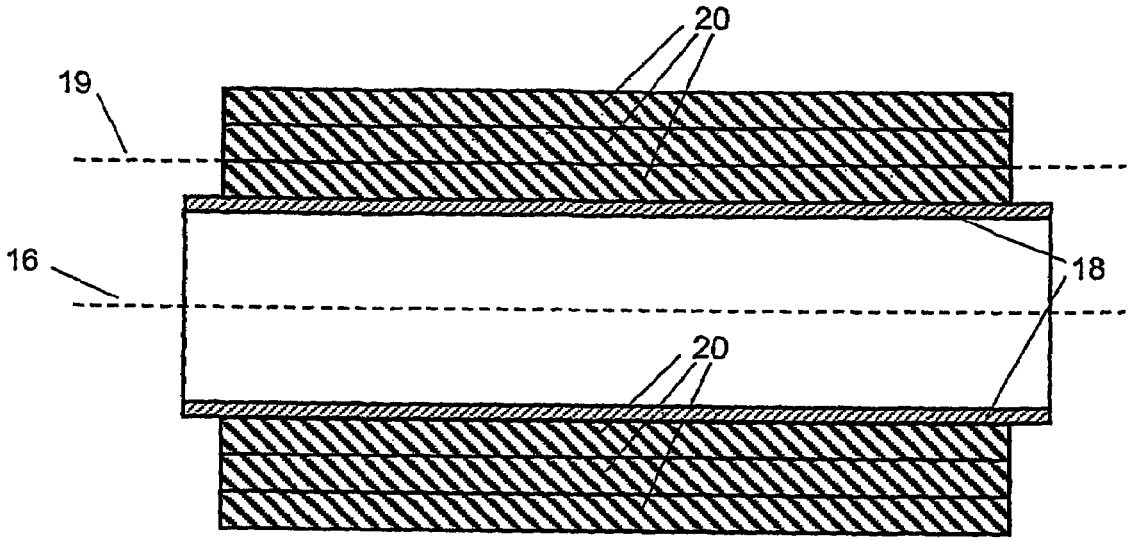
Figure 4:
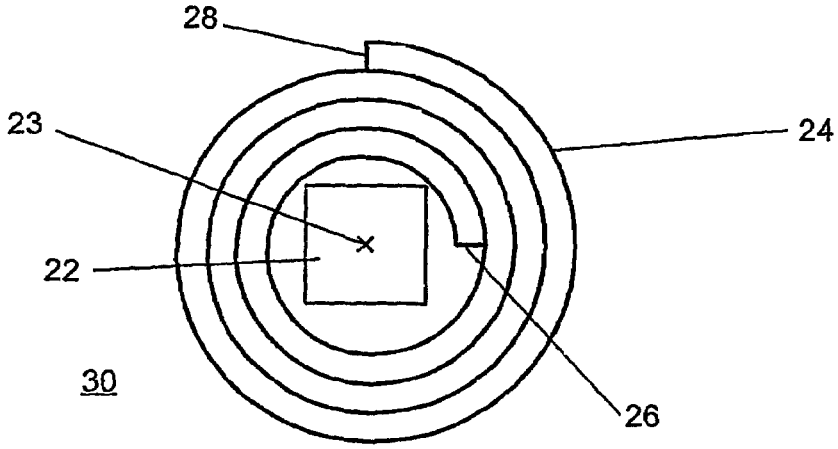

The invention, advantageous refinements and improvements of the invention, as well as further advantages, will be explained and described in more detail with reference to the drawings, which illustrate exemplary embodiments of the invention, and in which:

FIG. 1 shows a cross section through a winding material with one insulating material layer, FIG. 2 shows a cross section through a winding material with two insulating material layers, FIG. 3 shows a longitudinal section through a winding, and FIG. 4 shows a plan view of an end surface of a winding.

FIG. 1 shows a cross section at right angles to the longitudinal direction through a winding material 11. The winding material 11 has an electrical conductor 10 in the form of a strip, and an insulating material layer 12 which is non-detachably connected to a first broad face 101 of the conductor 10. The first broad face 101 of the conductor 10 in this case runs at right angles to the plane of the figure. Furthermore, a first narrow face 103, a second narrow face 104 and a second broad face 102 of the conductor can be seen in the illustrated figure.

A lateral direction 17 is located in the broad face 101 of the conductor 10 and is at right angles to the longitudinal direction of the conductor 10. The lateral direction 17 is the intersecting straight line from the broad face 101 of the conductor 10 and the plane of the figure.

The illustration shown here is not to scale and, in the case of a real conductor 10, the ratio of the length of a broad face to the length of a narrow face is about 20:1 to 1000:1, preferably 500:1. However, other ratios of the lengths of the broad face and narrow face are also feasible and are within the scope of the invention.

The conductor 10 is composed of a conductive material, for example copper, aluminum or an alloy having at least one of these materials. Epoxy resin or polyester imide may be used, inter alia, as the material for the insulating material layer 12. The insulating material layer 12 is applied to the conductor 10 by spray coating or powder coating, for example. It is likewise feasible for the insulating material layer 12 to be connected to the conductor 10 with the interposition of an adhesive layer, which is not shown here.

The width of the conductor 10 in one typical embodiment is about 300 mm to 1400 mm, preferably 1000 mm. The thickness of the conductor 10 is about 0.5 mm to 3 mm. This results in a typical conductor cross section of up to 4200 $mm^2$. However, other widths and/or thicknesses of the conductor 10 are also feasible.

This example is based on a continuous insulating material layer 12 which completely covers the broad face 101 of the conductor 10. However, it is also feasible to provide a plurality of insulating material layers, which are located alongside one another and each cover a sub-area of the broad face 101, instead of one continuous insulating material layer 12.

FIG. 2 shows a cross section at right angles to the longitudinal direction through a second winding material 13. This illustration is likewise not to scale. The reference symbols from FIG. 1 are adopted in the following text, where these relate to identical features to those in FIG. 1.

The second winding material 13 likewise has the conductor 10, which is non-detachably connected to a respective insulating material layer 12, 14 on its two broad faces 101, 102.

While the turns are being wound, the insulating material layer 12 of one turn is wound on the second insulating material layer 14 of the radially adjacent turn.

Radially adjacent turns of the conductor 10 are thus isolated from one another by two insulating material layers 12 and 14.

FIG. 3 shows a longitudinal section through a winding along a winding axis 16. This illustration is also not to scale. The winding has a plurality of turns 20 composed of a winding material which is wound around a hollow cylinder 18. The winding material has an electrical conductor in the form of a strip, as well as an insulating material layer, or two insulating material layers, although the conductor and the insulating material layers are not shown in this illustration.

In this example, the winding axis 16 coincides with the longitudinal axis of the hollow cylinder 18. In addition, a ferromagnetic core (which is not illustrated here) can be inserted into the hollow cylinder 18.

A further lateral direction 19 of the conductor of the winding material, which is defined as in FIG. 1, and which is shown for one of the turns 20, runs parallel to the winding axis 16. The turns 20 are located one on top of the other along the winding axis 16 without any axial offset, with radially adjacent turns overlapping approximately completely.

A winding such as this can be used, for example, in a power transformer for power transmission with a rating from about 50 kVA to 10 MVA. The winding can also be used in a transformer with a higher or lower rating. In particular, use is envisaged as an undervoltage winding for a rated voltage from about 1 kV to 30 kV or more. However, use at a lower voltage, from about 0.4 kV to 1 kV, is also feasible.

FIG. 4 shows a plan view of one end surface 30 of a winding which is part of a coil. This illustration is likewise not to scale. The turns are wound around a ferromagnetic core 22 which, in this example, has a square cross section. The winding axis of the turns coincides with the center axis 23 of the core 22.

In the illustrated figure, the turns are permanently connected to the core 22. Alternatively, the core 22 may be movable along its center axis 23. In this case, the inductance of the coil can be varied by insertion of the core 22 continuously or in steps into the turns, or by moving the core 22 out of the turns.

A connecting element, which is not shown here, is attached to a radially inner conductor end 26 of the winding. Furthermore, a second connecting element, which is likewise not illustrated, is attached to a radially outer connector end 28. The coil can be connected to a circuit by means of the connecting elements that have been mentioned.

The broad face of the outer turn, which faces away from the radially inner adjacent turn, forms an envelope surface 24 of the approximately cylindrical winding. Covering insulation, which is not shown here, is applied to the envelope surface 24 and to the end surface 30.

Covering insulation on the end surface 30 of the winding ensures insulation of the narrow faces, located there, of the conductor, which is not shown here. Covering insulation on the envelope surface 24 of the winding insulates the radially outer turn from the exterior.

LIST OF REFERENCE SYMBOLS

10: Conductor
11: Winding material
12: Insulating material layer
13: Second winding material
14: Second insulating material layer
16: Winding axis
17: Lateral direction
18: Hollow cylinder
19: Further lateral direction
20: Turn
22: Core
23: Center axis
24: Envelope surface
26: First conductor end
28: Second conductor end
30 End surface
101: First broad face
102: Second broad face
103: First narrow face
104: Second narrow face

The invention claimed is:

1. A winding for a transformer or a coil having an electrical conductor in the form of a strip and having at least one insulating material layer which, specifically the conductor and the at least one insulating material layer, are wound around a winding axis in order to form turns, wherein the conductor is non-detachably connected at least on one broad face to the at least one insulating material layer, and wherein radially adjacent turns are wound without any axial offset with respect to one another, wherein the at least one insulating material layer is applied to the conductor with the interposition of an adhesive layer.

2. The winding as claimed in claim 1, wherein the connection of the conductor to the at least one insulating material layer is formed in places or over the complete area on the at least one broad face.

3. The winding as claimed in claim 1, wherein the conductor is non-detachably connected to a respective insulating material layer on one or both broad faces.

4. The winding as claimed in claim 1, wherein this winding is covered by covering insulation, at least in places.

5. The winding as claimed in claim 1, wherein a first electrical connecting element is arranged at a radially inner conductor end.

6. The winding as claimed in claim 1, wherein a second electrical connecting element is arranged at a radially outer conductor end.

7. The winding as claimed in claim 1, wherein the conductor is arranged with its lateral direction, which is at right angles to its longitudinal direction and is located in the broad face, parallel to the winding axis.

8. The winding as claimed in claim 1, wherein the conductor has a width of 300 mm to 1400 mm, preferably 1000 mm.

9. The winding as claimed in claim 1, wherein the turns are arranged around a core.

10. The winding as claimed in claim 1, wherein the width of the conductor corresponds to the width of the at least one insulating material layer.

11. A method for production of a winding for a transformer or a core, in which a winding material in the form of a strip is wound around a winding axis without any axial offset to form turns, which winding material has an electrical conductor, which is in the form of a strip and is non-detachably connected to at least one insulating material layer, at least on one broad face, wherein the winding material is produced with the interposition of an adhesive layer between the conductor and the at least one insulating material layer.

12. The method as claimed in claim 11, wherein, before the turns are wound, the conductor is non-detachably connected to the at least one insulating material layer.

13. The method as claimed in claim 12, wherein, before the turns are wound, the conductor is connected in places or over the entire area to the at least one insulating material layer.

14. The method as claimed in claim 11, wherein the winding material is produced by connection of the conductor to a respective insulating material layer on both broad faces.

15. The method as claimed in claim 11, wherein after the turns have been wound, covering insulation is applied to the winding.

16. The method as claimed in claim 11, wherein before the turns are wound, a first electrical connecting element is connected to a first conductor end, and wherein the winding process is started with the first conductor end with the radially inner turn.

17. The method as claimed in claim 11, wherein after the turns have been wound, a second electrical connecting element is connected to a radially outer conductor end.

18. The method as claimed in claim 11, wherein the at least one insulating material layer of the winding material is non-detachably connected by its broad face facing away from the conductor to the broad face of the winding material of the respective radially adjacent turn.

19. The winding as claimed in claim 1, further comprising a ferromagnetic core.

20. The winding as claimed in claim 19, wherein the ferromagnetic core is a solid core.

21. The method as claimed in claim 11, wherein the core is a ferromagnetic core.

22. The method as claimed in claim 21, wherein the ferromagnetic core is a solid core.

* * * * *